United States Patent [19]

Bender

[11] Patent Number: 4,619,592

[45] Date of Patent: Oct. 28, 1986

[54] PUMPING SYSTEM HAVING A MAIN PUMP AND A PLURALITY OF SELECTIVELY OPERABLE SUBSIDIARY PUMPS

[76] Inventor: Fredrick L. Bender, 4825 Holland Rd., Saginaw, Mich. 48601

[21] Appl. No.: 586,414

[22] Filed: Mar. 5, 1984

[51] Int. Cl.[4] ..... F04B 23/04

[52] U.S. Cl. ..... 417/429; 417/214; 417/273; 92/68

[58] Field of Search ..... 417/214, 319, 270, 271, 417/273, 223, 385, 426, 429, 529; 92/13.1, 60.5, 68, 174; 60/541, 544

[56] References Cited

U.S. PATENT DOCUMENTS

| | | | |
|---|---|---|---|
| 1,109,349 | 9/1914 | Mealey | 417/214 |
| 1,707,508 | 4/1929 | Case | 417/214 |
| 2,064,750 | 12/1936 | Hurst | 417/214 |
| 2,720,842 | 10/1955 | Downing | 417/511 X |
| 2,987,003 | 6/1961 | Kress | 417/214 |
| 3,106,168 | 10/1963 | Kolbe | 417/471 X |
| 4,248,045 | 2/1981 | Turner | 92/60.5 X |
| 4,416,588 | 11/1983 | Karliner | 417/319 X |

FOREIGN PATENT DOCUMENTS

| | | | |
|---|---|---|---|
| 2431938 | 1/1976 | Fed. Rep. of Germany | 417/273 |
| 1134962 | 12/1956 | France | 417/273 |
| 1242851 | 8/1971 | United Kingdom | 417/273 |
| 2065790 | 5/1981 | United Kingdom | 417/273 |

*Primary Examiner*—William L. Freeh
*Assistant Examiner*—Paul F. Neils
*Attorney, Agent, or Firm*—Learman & McCulloch

[57] ABSTRACT

A pump system having a main pump and a plurality of subsidiary pumps each of which has a relatively low pressure compartment from which fluid may be pumped to a relatively high pressure compartment. The main pump preferably operates continuously, but each of the subsidiary pumps is inactive until such time as it is elected to be operated, whereupon high pressure fluid from the main pump may be directed to such subsidiary pump. The pump system is particularly adapted for use in conjunction with an automotive engine.

12 Claims, 3 Drawing Figures

PUMPING SYSTEM HAVING A MAIN PUMP AND A PLURALITY OF SELECTIVELY OPERABLE SUBSIDIARY PUMPS

This invention relates to a pump system that is especially adapted for, but not limited to, use with a motor vehicle having a plurality of pressure fluid operated devices any one or more of which may be operated or disabled as desired. The system is particularly adapted for use on small utility vehicles, as well as large trucks and off highway equipment having power steering and hydraulically operated auxiliary units such as a concrete mixer, a snowplow, a grader blade, a hoist, lift gates, outriggers, and the like.

BACKGROUND OF THE INVENTION

A truck equipped with one or more auxiliary hydraulic units conventionally employs a main hydraulic pump which may be driven from a power takeoff or is connected to a vehicle crankshaft either directly or via belts and pulleys. Each auxiliary unit conventionally is coupled to the main pump by hydraulic lines through which pressure fluid is circulated continuously if the main pump operates continuously, or to a hydraulic motor that communicates with the main pump. It thus has been necessary to include in conventional systems complex valve, flow divider, or clutch arrangements to enable an operator to assert effective control over the operation of the main pump and the auxiliary units operated thereby.

Among the objects of the present invention is to provide a pump system which minimizes the complexities of known constructions.

SUMMARY OF THE INVENTION

A pump system constructed in accordance with the invention is adapted for use in conjunction with a vehicle engine or other prime mover having a rotary shaft on which is fixed a flywheel, a cam, or both. Mounted on a suitable support adjacent the cam is a main pump having an actuator in the path of rotation of and engageable by the cam to circulate pressure fluid from a reservoir to a device such as a power steering unit which operates continuously as long as the engine runs.

The system includes one or more subsidiary pumps each of which is mounted adjacent the cam and each of which has an actuator which is operable to engage the cam so as to effect operation of the associated subsidiary pump and circulate pressure fluid from the reservoir to the unit that is to be operated by such pump. Normally, the actuators of the subsidiary pumps are maintained in a disabled condition in which they are inactive. When it is desired to activate a subsidiary pump, however, a suitable valve may be operated so as to enable pressure fluid from the main pump to flow to the subsidiary pump and adjust the actuator thereof to a position in which it lies in the path of and is engageable by the rotary cam. Engagement of the actuator by the rotary cam effects operation of the subsidiary pump so as to circulate pressure fluid therefrom to the unit that is to be operated thereby.

THE DRAWINGS

A presently preferred embodiment of the invention is disclosed in the following description and in the accompanying drawings, wherein.

DETAILED DESCRIPTION

Figure 1:
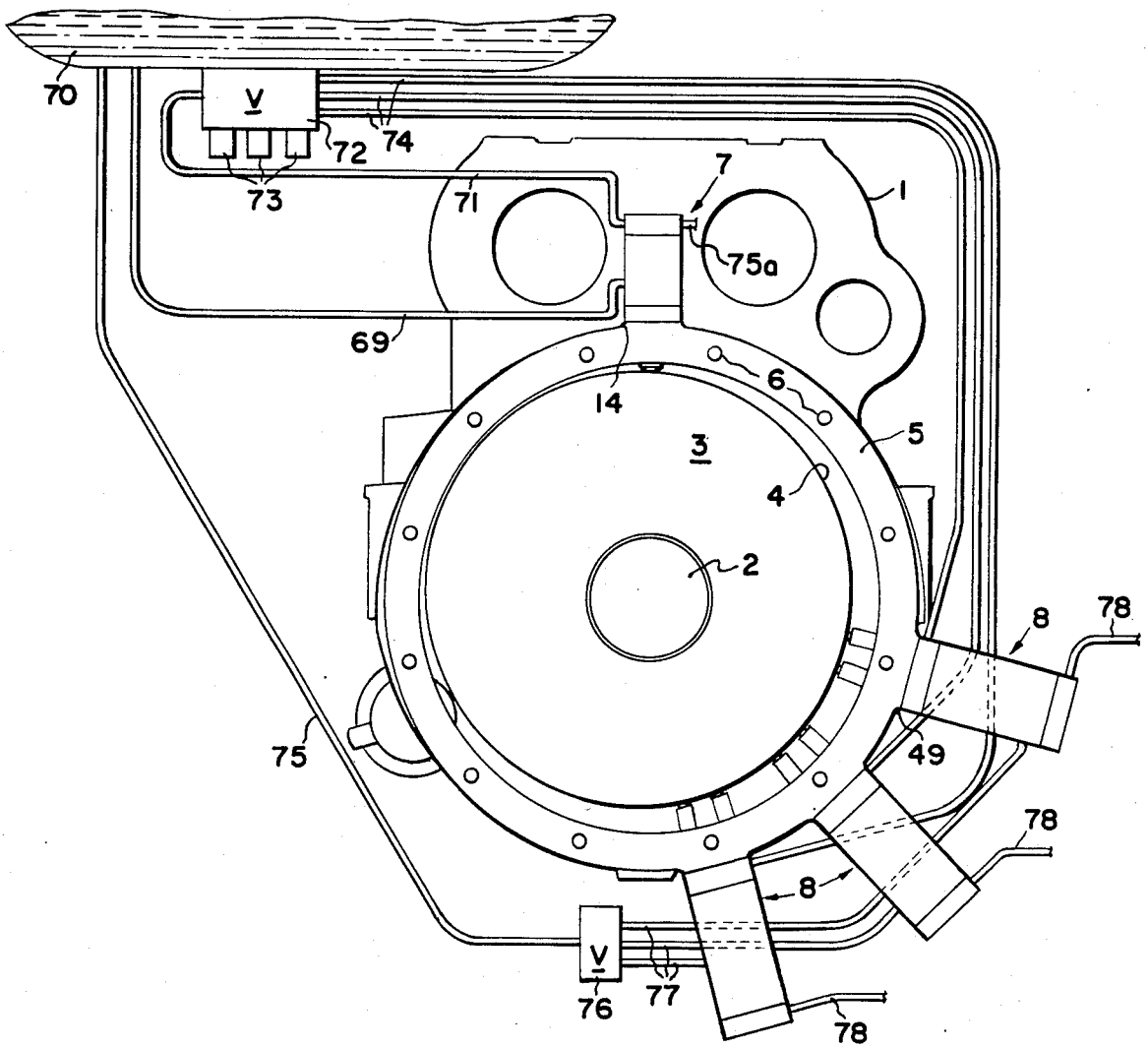
FIG. 1 is an end elevational view of a typical automotive engine equipped with a pump system constructed in accordance with the invention.

A pump system constructed in accordance with the invention is adapted for use in conjunction with an automotive engine 1 of the kind that is used on either diesel or gasoline powered vehicles. The engine 1 need not necessarily be mounted in a vehicle; it could be a stationary engine associated with a pumping station. In any event, the engine includes a rotary crankshaft 2 which protrudes beyond the cylinder block and has secured thereto a rotary, eccentric cam 3 having a peripheral surface 4. An annular mounting frame 5 is secured to the engine 1 by suitable bolts 6. The frame 5 is coaxial with the crankshaft 2 and is of such diameter as to enable the cam 3 to rotate within the confines of the frame so that the cam's periphery 4 is eccentric to the inner surface of the frame.

Figure 2:
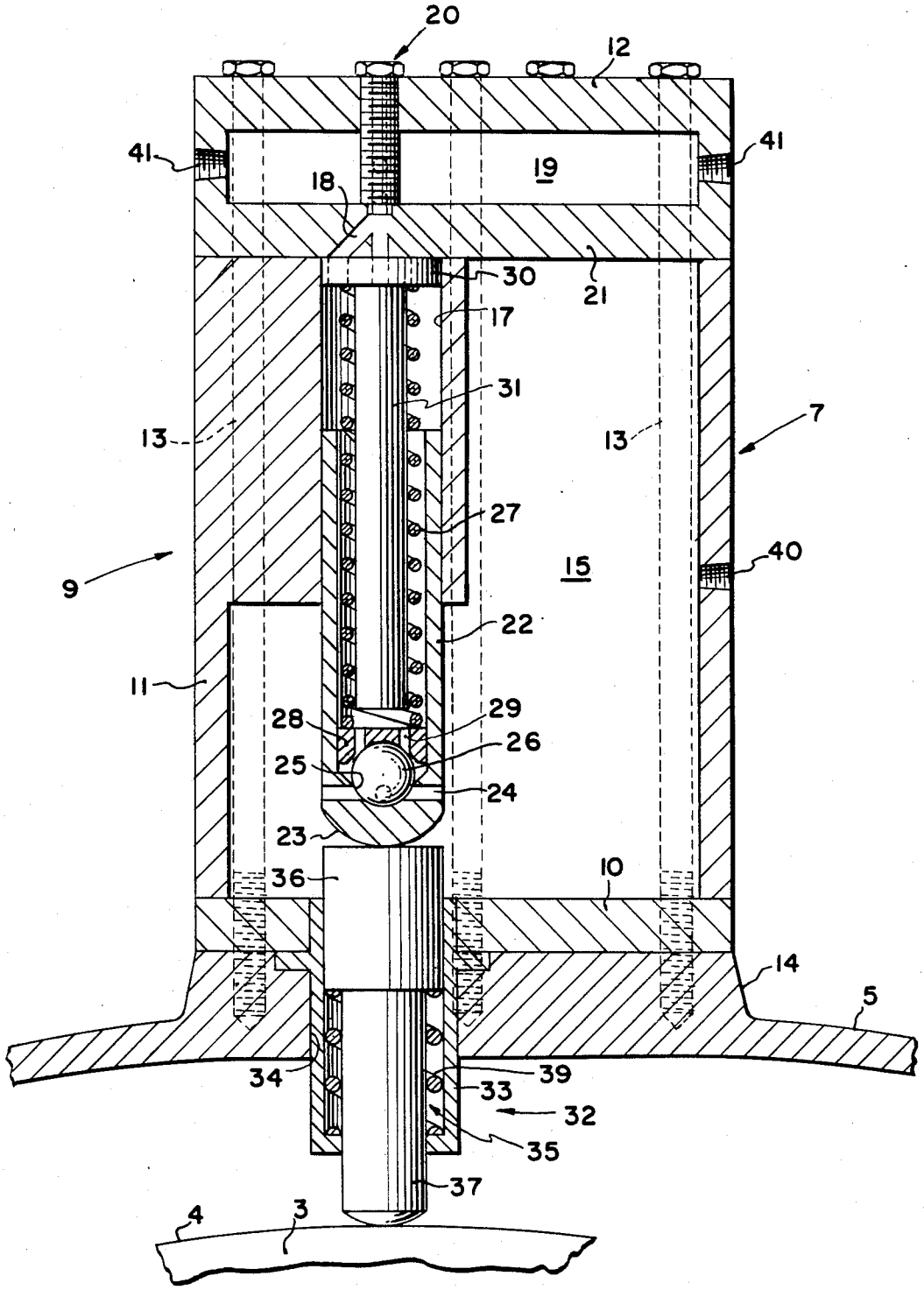
FIG. 2 is a vertical sectional view, on an enlarged scale, of the main pump forming part of the system.
Figure 3:
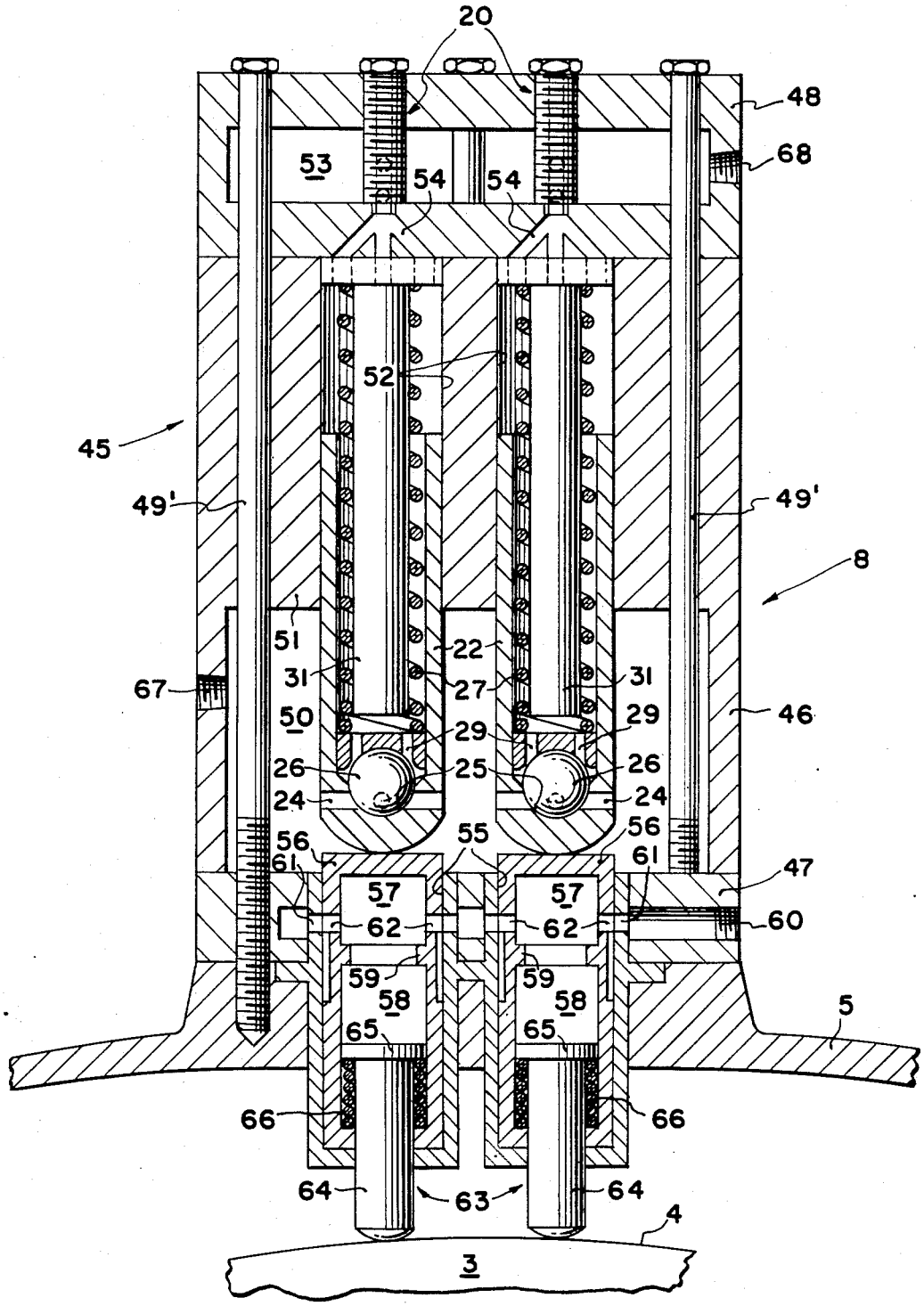
FIG. 3 is a vertical sectional view through one of the subsidiary pumps forming part of the system.

At any convenient location around the periphery of the frame 1 is mounted a main pump 7 and one or more subsidiary pumps 8. In the illustrated embodiment there are three subsidiary pumps, but more or fewer could be provided. The main pump is best shown in FIG. 2 and comprises a preferably rectangular body 9 having a bottom 10, an upstanding side wall 11 and a top block 12. The parts 10, 11, and 12 are maintained in assembled relation by a plurality of bolts 13 which also secure the body to a mounting pad 14 carried by the frame 5.

The body 9 has a relatively large, low pressure compartment 15 therein and into which projects a block 16 having a bore or chamber 17. In communication with the chamber 17 is a number of angularly spaced ports 18 which establish communication between the compartment 15 and a relatively high pressure compartment 19 formed in the top block 12. The port 18 normally is closed by a check valve 20 of conventional construction.

Reciprocably accommodated in the chamber 17 is a hollow piston 22 closed at one end by a rounded tip 23. The piston is open at its other end. Adjacent its rounded end 23 the piston is provided with a plurality of circumferentially spaced ports 24 that extend through a semispherical seat 25 on which a ball valve 26 is adapted to bear. The ball 26 normally is urged toward the seat 25 by a spring 27 which bears at one end on a disc 28 provided with fluid passages 29. The opposite end of the spring 27 seats on a ported disc 30 which confronts the port 18 and carries a spring guide 31 that is accommodated within the spring 27. The piston 22 is reciprocable within the bore 17, but normally is urged to a projected position by the spring 27. In the position shown in FIG. 2, the piston is in its retracted position.

Actuating means 32 is provided for effecting reciprocation of the piston 22 and comprises a cylinder 33 extending through and fixed in an opening 34 in the frame 5 and the mounting pad 14. Reciprocable in the cylinder 33 is a plunger 35 having at its inner end an enlargement 36 and at its outer end a reduced diameter extension 37 which passes through an opening 38 in the cylinder 33. A spring 39 urges the plunger 35 toward a retracted position within the cylinder 33 so as to maintain engagement between the closed end 23 of the piston 22 and the end 36 of the plunger 35.

The side wall 11 of the pump 7 has an opening 40 therein for supplying the compartment 15 with pressure fluid, such as oil. The top block 12 has openings 41 therein in communication with the compartment 19 for enabling fluid to be discharged from such compartment.

Each of the subsidiary pumps 8 is identical and comprises a rectangular body 45 having an upstanding side wall 46 interposed between a base 47 and a top block 48. The parts 46–48 are maintained in assembled relation by bolts 49' which also secure the body 45 on a mounting pad 49 forming part of the frame 5. The body 45 is provided with an internal compartment 50 having a cross member 51 therein in which is a pair of parallel bores or chambers 52 which communicate with a compartment 53 in the top block 48 via ports 54.

Accommodated in each of the bores 52 is a reciprocable piston and associated parts corresponding to those referred to earlier. Hence, corresponding reference characters are used to designate corresponding parts. Similarly, a check valve 20 like the check valve described earlier is associated with each of the ports 54 and functions in a like manner.

The base 47 of each subsidiary pump 8 is provided with a pair of spaced bores 55 in axial alignment with the respective pistons 22. Accommodated in each bore 55 is a hollow plunger 56 each of which has a pair of axially spaced chambers 57 and 58 spaced apart by a throat 59. The base 47 has a fluid passage 60 which communicates with each bore 55 via ports 61 and with the chamber 57 of the associated plunger 56 via ports 62.

Within the chamber 58 of each plunger 56 is an actuator 63 having a stem 64 which projects through aligned openings in the plunger and cylinder. The inner end of the stem terminates in an enlarged flange 65. A spring 66 acts on the flange 65 and constantly biases the actuator 63 to a retracted position.

The side wall 46 of each pump 8 has a fluid inlet 67 therein and through which pressure fluid may be introduced into the compartment 50. The top block 48 has an outlet 68 through which pressure fluid may be discharged from the compartment 53.

To condition the apparatus for operation, the cam 3 is mounted on the crankshaft 2 and frame 5 is mounted on the engine 1. The main pump 7 and as many subsidiary pumps as are desired may be fitted to the frame 5 so that the actuators 32 and 63 lie in the path of and are engageable by the cam. The compartment 15 of the pump 7 is coupled via a tube 69 to a reservoir 70 of pressure fluid which preferably has a sufficient head to ensure filling of the compartment 15 with fluid under relatively low pressure. The compartment 19 of the pump 7 is coupled to the reservoir via a tube 71 and a valve body 72 having a number of movable elements the position of each of which is controlled by conventional solenoid actuators 73. Each valve is a two-way valve, in one position of which the fluid delivered thereto from the pump 7 is returned to the reservoir and in the other position of which such fluid is delivered to a tube 74 which leads to the passage 60 at the base 47 of the associated subsidiary pump 8. The pump 7 also has a tube 75 in communication with the compartment 19 and which leads to a continuously operated hydraulic unit (not shown), such as a power steering mechanism, from which fluid is returned to the reservoir as is conventional.

Extending from the reservoir 70 to a valve housing 76 is a tube **75*a*. The valve housing 76 contains as many movable valve elements as there are subsidiary pumps 8, and each element is controlled by the solenoid actuators like the actuators 73 73. Between the valve housing 76 and each subsidiary pump 8 extends a tube 77 which communicates with the associated chamber 50 via its inlet 67. The delivery of fluid from the reservoir to the compartment 53 of each of the pumps 8 is independent of the main pump 7 and its compartments. Each subsidiary pump 8 has a tube 78 which establishes communication between the compartment 53** and some other pressure fluid operated mechanism (not shown) from which the fluid is returned to the reservoir as is conventional.

At the time the engine 1 is started, the head of the fluid in the reservoir 70 is sufficient to ensure that the compartment 15 of the pump 7 is full of oil under relatively low pressure. Further, the spring 27 biases the piston 22 and the plunger 35, against the tension of the spring 39, to a position in which the actuator stem 37 lies in the path of rotation of the peripheral surface 4 of the cam 3 so as to be engageable therewith. The head under which the fluid in the compartment 15 is maintained is sufficient to enable the ball check 26 to be displaced and permit fluid to enter the interior of the piston 22 via the ports 24 and to fill the chamber 17. The check valve 20, however, prevents the flow of fluid into the chamber 19.

As the cam 3 rotates, its surface 4 will displace the actuator 35 radially of the cam and transmit a force to the piston 22 to displace the latter in the direction of the compartment 19. Such movement of the piston 22 will cause the volume of the space between the check valve 26 and the port 18 to be reduced, thereby causing the fluid in the chamber 17 to exert a force on the ball check 26 causing the latter to seat on the surface 25 and close the ports 24. Continued movement of the piston 22, therefore, will cause fluid to displace the check valve 20 and deliver fluid under relatively high pressure to the compartment 19.

High pressure fluid from the compartment 19 flows via the tube 71 to the valve housing 72, as well as through the tube **75*a* to the power steering or other continuously operating unit. The quantity of fluid contained in the compartment 15 and the size and stroke of the piston 22 are so proportioned as to ensure an ample supply of fluid from the pump 7** to all units operated thereby.

If the solenoid valve actuators 73 are inactive, the pump 7 will operate simply to supply fluid to the power steering or other unit and to circulate fluid from the reservoir 70 through the pump 7 and back to the reservoir. As long as no fluid from the pump 7 is supplied via the valve housing 72 and the associated line 74 to a subsidiary pump 8, the actuating members 64 will be maintained by their associated springs 66 in a retracted position within the associated plungers 56 so as to avoid contact between the actuators and the cam surface. Thus, the pump 8 is inactive.

When it is desired to activate a subsidiary pump 8, the appropriate solenoid actuator 73 is energized by suitable, conventional means such as a switch (not shown) whereupon high pressure fluid may flow through the appropriate line 74 to the inlet 60 in the base 47 and through the appropriate line 77 to the inlet 67 of the pump 8. Fluid which passes through the inlet 67 is under relatively low pressure, compared to that of the fluid introduced to the inlet 60, but the pressure of the fluid admitted to the compartment 50 is sufficient to fill the latter, the interior of the pistons 22, and the chambers 52 with fluid. The pressure of fluid which enters the inlet 60 is sufficiently high to displace the actuators 64 outwardly toward the cam surface 4. Rotation of the cam 3 therefore, can effect displacement of the plungers 56 inwardly of the pump, thereby causing displacement of the pistons 22 in the same manner as described previously so as to deliver fluid under relatively high pressure to the compartment 53 whence it may be delivered via the appropriate line 78 to the unit to be operated.

It will be understood that appropriate pressure relief valves and other conventional hydraulic components will be incorporated in an operating system, but such components are not disclosed in detail inasmuch as they form no part of the invention per se.

This disclosure is representative of a presently preferred embodiment of the invention, but is intended to be illustrative rather than limited thereof. The invention is defined in the claims.

I claim:

1. A pressure fluid pumping system comprising a main fluid pump having a fluid inlet and a fluid outlet and at least one subsidiary fluid pump having a fluid inlet and a fluid outlet; means coupling the fluid inlet of said main pump to a source of fluid; means coupling the fluid outlet of said main pump to a fluid circuit incorporating said subsidiary pump; valve means in said circuit for selectively diverting fluid from said subsidiary pump or delivering fluid thereto; means independent of said fluid inlet and said fluid outlet of said main pump and coupling said subsidiary pump to a source of hydraulic fluid; driving means for driving said main pump and said subsidiary pump; actuator means carried by said subsidiary pump and engageable with said driving means to effect operation of said subsidiary pump; and means mounting said actuator means for movements out of and into engagement with said driving means in response to the diversion from or delivery thereto of fluid from said main pump.

2. A system according to claim 1 wherein said driving means comprises a cam.

3. A system according to claim 1 wherein said actuator means comprises a reciprocable piston.

4. A system according to claim 3 including biasing means normally maintaining said actuator means in a position out of engagement with said driving means, the delivery of said fluid to said subsidiary pump from said main pump disabling said biasing means.

5. A fluid pump comprising a housing having therein a relatively high pressure compartment and a relatively low pressure compartment; a fluid chamber between said compartments having fluid inlet means in communication with said low pressure compartment and fluid outlet means in communication with said high pressure compartment; reciprocable piston means operable in response to movement in one direction to deliver fluid from said chamber to said high pressure compartment; and force transmitting means for effecting reciprocation of said piston means, said force transmitting means comprising a hollow, reciprocable plunger within said low pressure compartment on which said piston means bears, an actuator carried within said plunger for movements relative thereto between extended and retracted positions, and fluid port means independent of said compartments communicating with said plunger for enabling pressure fluid to flow into and out of said plunger, the presence or absence of fluid in said plunger respectively disabling or enabling relative movement of said plunger and said actuator.

6. A pump according to claim 1 wherein said reciprocable plunger is in axial alignment with said piston means.

7. A pump according to claim 6 including spring means biasing said piston means toward said plunger.

8. A pump according to claim 1 wherein said actuator is reciprocable within said hollow plunger.

9. A pump according to claim 8 including spring means biasing said actuator to a retracted position within said hollow plunger.

10. A pump according to claim 1 wherein said piston means comprises a hollow member slidably accommodated in said chamber.

11. A pump according to claim 10 wherein one end of said hollow member extends from said chamber into said low pressure compartment for engagement by said force transmitting means.

12. A pump according to claim 11 wherein said one end of said hollow member has a fluid port therein and check valve means operable to enable fluid flow through said port in a direction into said chamber only.

* * * * *